US009114945B2

(12) United States Patent
Fujihara et al.

(10) Patent No.: US 9,114,945 B2
(45) Date of Patent: Aug. 25, 2015

(54) SHEET TRANSPORT APPARATUS

(71) Applicant: Kabushiki Kaisha Toshiba, Tokyo (JP)

(72) Inventors: Hiroaki Fujihara, Kanagawa-ken (JP); Yoshihiko Naruoka, Kanagawa-ken (JP); Yukio Asari, Kanagawa-ken (JP); Naruaki Hiramitsu, Kanagawa-ken (JP); Yusuke Mitsuya, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/200,103

(22) Filed: Mar. 7, 2014

(65) Prior Publication Data

US 2014/0265112 A1 Sep. 18, 2014

(30) Foreign Application Priority Data

Mar. 15, 2013 (JP) ..... 2013-053275

(51) Int. Cl.

| | |
|---|---|
| ***B65H 5/00*** | (2006.01) |
| ***B65H 7/16*** | (2006.01) |
| ***B65H 5/02*** | (2006.01) |
| ***B65H 5/22*** | (2006.01) |
| ***B65H 29/24*** | (2006.01) |
| ***B65H 7/02*** | (2006.01) |

(52) U.S. Cl.

CPC ..... *B65H 7/16* (2013.01); *B65H 5/023* (2013.01); *B65H 5/228* (2013.01); *B65H 7/02* (2013.01); *B65H 29/245* (2013.01); *B65H 2301/447* (2013.01); *B65H 2301/4474* (2013.01); *B65H 2404/264* (2013.01); *B65H 2511/514* (2013.01); *B65H 2515/212* (2013.01); *B65H 2701/1311* (2013.01); *B65H 2701/1313* (2013.01); *B65H 2701/1912* (2013.01)

(58) Field of Classification Search

CPC ..... B65H 2406/11; B65H 2406/112; B65H 2406/1132; B65H 2406/131; B65H 2406/14

USPC ..... 271/264, 265.01, 265.02, 272–274, 271/314, 275, 276, 69, 189, 195, 11, 90, 93, 271/97

See application file for complete search history.

(56) References Cited

U.S. PATENT DOCUMENTS 3,236,517 A * 2/1966 Lyman ..... 271/5
4,106,767 A 8/1978 Schirrmeister et al.

(Continued)

FOREIGN PATENT DOCUMENTS

JP 2004-284751 A 10/2004
JP 2006-089167 A 4/2006

OTHER PUBLICATIONS

Extended European Search Report issued in related European Patent Application No. 14157794.0 mailed Nov. 18, 2014, 4 pages.

*Primary Examiner* — Thomas Morrison
(74) *Attorney, Agent, or Firm* — Baker Botts L.L.P.

(57) ABSTRACT

A sheet transport apparatus including an upstream-side transport unit configured to hold a sheet and transport the sheet by rotating; a downstream-side transport unit configured to hold the sheet and further transport the sheet by rotating, the downstream-side transport unit being arranged at such a position that an unrestrained transport section is formed where the sheet is not held downstream in transport direction from the upstream-side transport unit; an upstream-side air-feed unit configured to form an air flow that flows downstream in transport direction on both sides of a transport plane of the sheet in the unrestrained transport section; and a controller configured to control the upstream-side air-feed unit to start forming an air flow before a leading edge of the sheet reaches the unrestrained transport section from the upstream-side transport unit, and to stop the air flow before a trailing edge of the sheet reaches the unrestrained transport section.

3 Claims, 5 Drawing Sheets

(56) References Cited

U.S. PATENT DOCUMENTS 5,336,873 A * 8/1994 Imamura ..... 235/462.05
5,634,636 A * 6/1997 Jackson et al. ..... 271/225
6,305,442 B1 10/2001 Ovshinsky et al.
6,305,772 B1 * 10/2001 Berkoben et al. ..... 347/4
2002/0003220 A1 * 1/2002 Shibabuki et al. ..... 250/586
2008/0047802 A1 * 2/2008 Nireki ..... 194/302
2010/0225983 A1 * 9/2010 Fujii et al. ..... 358/498
2011/0109034 A1 5/2011 Ugajin

* cited by examiner

| COMPONENT | SITUATION | SENSOR 12 | SENSOR 14 |
|---|---|---|---|
| VALVE 5b | CLOSE | 0 | 0 |
| | | 0 | 1 |
| | | 1 | 1 |
| | OPEN | 1 | 0 |
| VALVE 6b | CLOSE | 0 | 0 |
| | | 1 | 0 |
| | | 0 | 1 |
| | OPEN | 1 | 1 |

SITUATION OF SENSOR
0 : LIGHT (SHEET NON EXISTENT)
1 : DARK (SHEET EXISTING)

SHEET TRANSPORT APPARATUS

CROSS-REFERENCE TO RELATED APPLICATION

This application is based upon and claims the benefit of priority from Japanese Patent Application No. 2013-053275, filed on Mar. 15, 2013; the entire contents of which are incorporated herein by reference.

FIELD

Embodiments described herein relate generally to a sheet transport apparatus for continuously transporting a plurality of sheets.

BACKGROUND

Conventionally, there are sheet transporting apparatuses that carry out a so-called unrestrained transport, in which the sheets are transported in a free state in which they are not restrained by transport rollers or the like. For example, guide members may be arranged on both sides of the transport plane of the sheets in such a device. The guide members on both sides form an air pool between the opposing faces respectively facing the transport plane. Air is blown from a direction that is orthogonal to the transport plane through air nozzles, which pass through the guide members, into this air pool. By blowing air, an air flow layer for transporting the sheets in a stable orientation between the guide members (between the two opposing faces) is formed.

With the above-described conventional transport apparatus, since the air is blown orthogonally from the sides of the transport plane of the sheets, the air flow in the air flow layer may become unstable in a situation in which no sheets are transported. For this reason, if a plurality of sheets are continuously transported, the air flow may become particularly unstable in the region between the sheets, which may cause a disruption of the transport orientation of the sheets.

In particular in apparatuses in which characteristics are detected by directing light at the sheets in such an unrestrained transport state, it may not be possible to stably pass the sheets through the focus position of the light if the transport orientation of the sheets is disrupted, thus lowering the detection precision due to blurring of the image.

Thus, there is a demand for development of a sheet transport apparatus that can carry out unrestrained transport of sheets in a stable orientation.

DETAILED DESCRIPTION

According to one embodiment, there is provided a sheet transport apparatus including an upstream-side transport unit configured to hold a sheet and transport the sheet by rotating; a downstream-side transport unit configured to hold the sheet and further transport the sheet by rotating, the downstream-side transport unit being arranged at such a position that an unrestrained transport section is formed where the sheet is not held downstream in transport direction from the upstream-side transport unit; an upstream-side air-feed unit configured to form an air flow that flows downstream in transport direction on both sides of a transport plane of the sheet in the unrestrained transport section; and a controller configured to control the upstream-side air-feed unit to start forming an air flow before a leading edge of the sheet reaches the unrestrained transport section from the upstream-side transport unit, and to stop the air flow before a trailing edge of the sheet reaches the unrestrained transport section.

The following is a detailed explanation of embodiments, with reference to the drawings.

Figure 1:
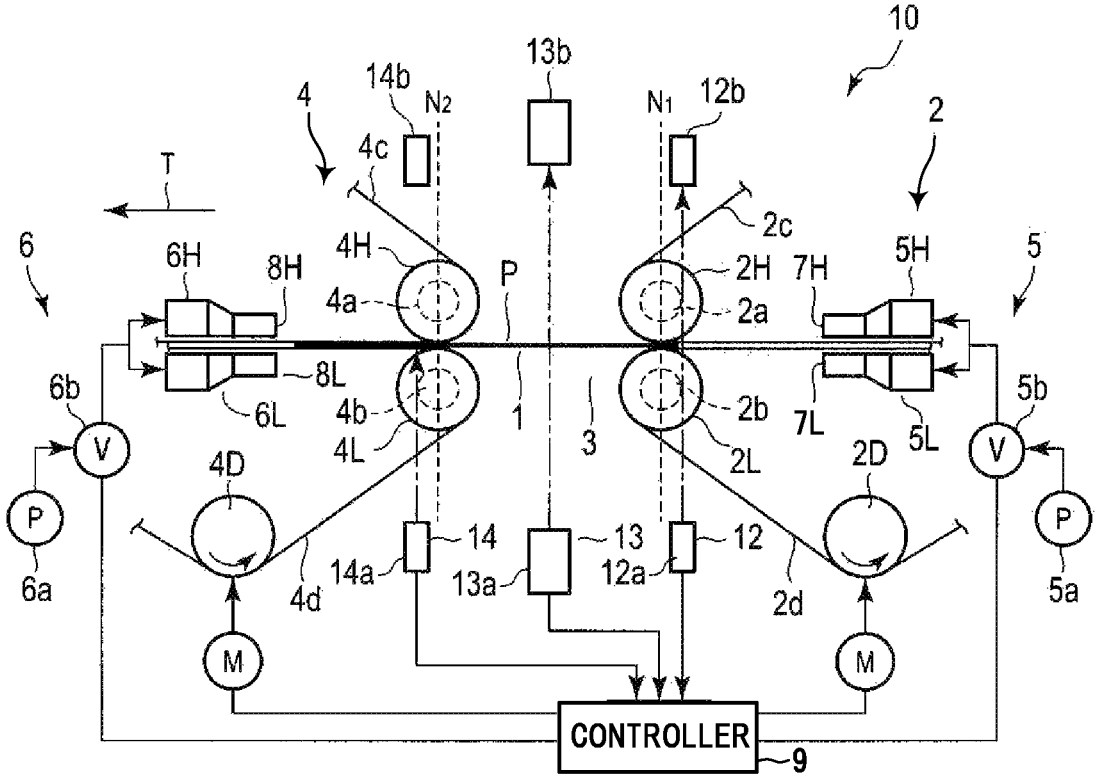
FIG. 1 is a front view of a sheet transport apparatus according to a first embodiment.
Figure 2:
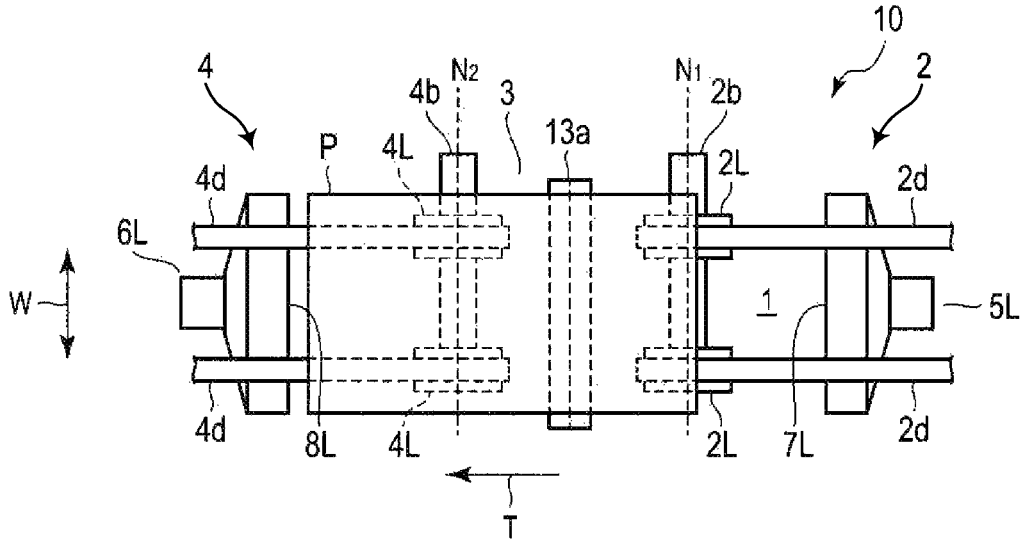
FIG. 2 is a top view of the transport apparatus in FIG. 1, viewed from above the transport plane.

FIG. 1 is a front view of a sheet transport apparatus 10 according to a first embodiment (referred to simply as transport apparatus 10 below). FIG. 2 is a top view of this transport apparatus 10, viewed from above a transport plane. In FIG. 1, the configuration of the control system controlling the operation of the transport apparatus 10 is shown as a block diagram. In FIG. 2, the structural elements above the transport plane are not depicted, in order to make the structure on the lower side of the transport plane easier to see.

The transport apparatus 10 includes a transport plane 1 (transport path) extending substantially horizontally, on which a plurality of relatively thin and light sheets P, such as banknotes, are continuously transported in the direction of arrow T (to the left in the drawing). The plurality of sheets P are transported continuously at high speed (for example, about 10 m/s) along the transport plane 1 with a constant transport spacing (gap) between them. In the present embodiment, the sheets P are transported along their longitudinal direction in a substantially horizontal orientation, as shown in FIG. 2.

On the upstream side with respect to transport direction of the sheets P (on the right in the drawing), an upstream-side transport unit 2 is provided that holds the sheets P that are transported along the transport plane 1 from above and below with belts 2*c* and 2*d*, and transports the sheets P in the direction of the arrow T by rotating these belts 2*c* and 2*d*. Moreover, at a certain distance to the downstream side in transport direction from the upstream-side transport unit 2, a downstream-side transport unit 4 is provided that receives the sheets P, which have been transported by the upstream-side transport unit 2, at a transport nip (N2) and holds the sheets P from above and below with belts 4*c* and 4*d*, and transports the sheets P in the direction of the arrow T by rotating these belts 4*c* and 4*d*. Between the upstream-side transport unit 2 and the downstream-side transport unit 4, an unrestrained transport section 3 is provided, where the sheets P are transported unrestrained along the transport plane 1 in a substantially horizontal orientation.

To explain this in more detail, the upstream-side transport unit 2 includes two upper transport rollers 2H (only one is shown in FIG. 1) that are arranged adjacently above the transport plane 1, and two lower transport rollers 2L that are arranged adjacently below and opposite to the two upper transport rollers 2H, sandwiching the transport plane 1 therebetween. The thickness in axial direction of the transport rollers 2H, 2L is set to a necessary minimum thickness, and they are arranged at positions facing each other across the transport plane 1.

The two upper transport rollers 2H are attached coaxially and at a certain distance from each other, on a rotation shaft 2*a* that extends parallel to the width direction (direction of the arrow W in FIG. 2), which is orthogonal to the transport direction T and also orthogonal to the perpendicular direction. The two lower transport rollers 2L are attached coaxially and at a distance from each other (at the same distance as the two upper transport rollers 2H), on a rotation shaft 2*b* that extends along the width direction W, parallel to the rotation shaft 2*a*. As shown in FIG. 2, the two upper transport rollers 2H and the two lower transport rollers 2L are respectively arranged at a distance from each other that is shorter than the length in width direction W of the sheets P to be transported along the transport plane 1.

The two upper transport belts 2*c* (only one is shown in FIG. 1), which are relatively thin, are respectively wound around the two upper transport rollers 2H. These two upper transport belts 2*c* are also wound around other rollers not shown in the drawings, and are spanned to an endless belt that can transport the sheets P in the transport direction T. It should be noted that the two upper transport belts 2*c* include a region in which they extend in the transport direction T, parallel to the transport plane 1. That is to say, after the two upper transport belts 2*c* have run in the transport direction T along the transport plane 1, they are wound around the upper transport rollers 2H, and are led into a direction away from the transport plane 1.

On the other hand, the two lower transport belts 2*d*, which are relatively thin, are respectively wound around the two lower transport rollers 2L. These two lower transport belts 2*d* are each wound around a driving roller 2D, and are spanned to an endless belt that can transport the sheets P in the transport direction T. Also the two lower transport belts 2*d* include a region in which they extend in the transport direction T, parallel to the transport plane 1. This region is opposite to the upper transport belts 2*c*, across the transport plane 1. That is to say, after the two lower transport belts 2*d* have run in the transport direction T along the transport plane 1, they are wound around the lower transport rollers 2L, and after that, they are wound around the driving rollers 2D.

The horizontal region where the upper transport belts 2*c* are spanned along the upper side of the transport plane 1 and the horizontal region where the lower transport belts 2*d* are spanned along the lower side of the transport plane 1 touch each other across the transport plane 1. In other words, the horizontal region of the upper transport belts 2*c* and the horizontal region of the lower transport belts 2*d* have the function of being pressed against both sides of the sheets P passing along the transport plane 1, to eliminate any flapping.

The respective rotation shafts 2*a*, 2*b* of the upper transport rollers 2H and the lower transport rollers 2L opposing each other across the transport plane 1 are attached to a frame or the like (not shown) of the apparatus, in a state in which they are urged in a direction such that they approach each other, so that the outer faces of the transport belts 2*c*, 2*d* wound around the rollers 2H, 2L are pressed against each other across the transport plane 1 at a position where the upper and lower rollers 2H and 2L face each other.

That is to say, at a position (N1) where the upper transport rollers 2H and the lower transport rollers 2L oppose each other, and the sheets P that are transported on the transport plane 1 in the transport direction T are contacted with pressure by the upper transport belts 2*c* and the lower transport belts 2*d*, a relatively strong clamping force (that is, transport force) is applied from the upper and lower transport belts 2*c*, 2*d*. It should be noted that there is no need that the upper transport rollers 2H and the lower transport rollers 2L are in perfect opposition to each other, and it is also possible that the upper transport rollers 2H are arranged slightly more to the downstream side, for example. In this case, N1 is the position of the lower transport rollers 2L, and even if a plurality of overlapping banknotes approach, transport is possible by letting the upper transport belts 2*c* make an evading movement.

On the other hand, the downstream-side transport unit 4 includes two upper transport rollers 4H (only one is shown in FIG. 1) that are arranged adjacently above the transport plane 1, and two lower transport rollers 4L that are arranged adjacently below and opposite to the two upper transport rollers 4H, sandwiching the transport plane 1 therebetween. The thickness in axial direction of the transport rollers 4H, 4L is set to a necessary minimum thickness, and they are arranged at positions facing each other across the transport plane 1.

The two upper transport rollers 4H are attached coaxially and at a certain distance from each other, on a rotation shaft 4*a* that extends parallel to the width direction W. The two lower transport rollers 4L are attached coaxially and at a distance from each other (at the same distance as the two upper transport rollers 4H), on a rotation shaft 4*b* that extends along the width direction W, parallel to the rotation shaft 4*a*. The two upper transport rollers 4H and the two lower transport rollers 4L are respectively arranged at a distance from each other that is shorter than the length in width direction W of the sheets P to be transported along the transport plane 1.

The two upper transport belts 4*c* (only one is shown in FIG. 1), which are relatively thin, are respectively wound around the two upper transport rollers 4H. These two upper transport belts 4*c* are also wound around other rollers not shown in the drawings, and are spanned to an endless belt that can transport the sheets P in the transport direction T. It should be noted that the two upper transport belts 4*c* include a region in which they extend in the transport direction T, parallel to the transport plane 1. That is to say, after the two upper transport belts 4*c* have been wound around the upper transport rollers 4H, they run in the transport direction T along the transport plane 1.

On the other hand, also the two lower transport belts 4*d*, which are relatively thin, are respectively wound around the two lower transport rollers 4L. These two lower transport belts 4*d* are each wound around a driving roller 4D, and are spanned to an endless belt that can transport the sheets P in the transport direction T. Also the two lower transport belts 4*d* include a region in which they extend in the transport direction T, parallel to the transport plane 1. This region is opposite to the upper transport belts 4*c*, across the transport plane 1. That is to say, after the two lower transport belts 4*d* have been wound around the driving rollers 4D, they are wound around the lower transport rollers 4L and run in the transport direction T along the transport plane 1.

The horizontal region where the upper transport belts 4*c* are spanned along the upper side of the transport plane 1 and the horizontal region where the lower transport belts 4*d* are spanned along the lower side of the transport plane 1 touch each other across the transport plane 1. In other words, the horizontal region of the upper transport belts 4*c* and the horizontal region of the lower transport belts 4*d* have the function of being pressed against both sides of the sheets P passing along the transport plane 1, to eliminate any flapping.

The respective rotation shafts 4*a*, 4*b* of the upper transport rollers 4H and the lower transport rollers 4L opposing each other across the transport plane 1 are attached to a frame or the like (not shown) of the apparatus, in a state in which they are urged in a direction such that they approach each other, so that the outer faces of the transport belts 4*c*, 4*d* wound around the rollers 4H, 4L are pressed against each other across the transport plane 1 at a position where the upper and lower rollers 4H and 4L face each other.

That is to say, at a position (N2) where the upper transport rollers 4H and the lower transport rollers 4L oppose each other, and the sheets P that are transported on the transport plane 1 in the transport direction T are contacted with pressure by the upper transport belts 4*c* and the lower transport belts 4*d*, a relatively strong clamping force (that is, transport force) is applied from the upper and lower transport belts 4*c*, 4*d*. It should be noted that there is no need that the upper transport rollers 4H and the lower transport rollers 4L are in perfect opposition to each other, and it is also possible that the upper transport rollers 4H are arranged slightly more to the upstream side. In this case, N2 is the position of the lower transport rollers 4L, and even if a plurality of overlapping sheets P are transported, transport is possible by letting the upper transport belts 4*c* make an evading movement.

The unrestrained transport section 3 is the section between the position N1 (the transport nip N1 that holds and restrains the sheets P) where the upper transport rollers 2H and the lower transport rollers 2L of the upstream-side transport unit 2 face each other, and the position N2 (the transport nip N2 that holds and restrains the sheets P) where the upper transport rollers 4H and the lower transport rollers 4L of the downstream-side transport unit 4 face each other. In this section 3, no members are provided that come into touch with the sheets P transported along the transport plane 1, and the sheets P are freely transported without applying an external force in this section 3.

In the present embodiment, the length of the unrestrained transport section 3 (that is, the distance between N1 and N2) is shorter than the length, along the transport direction T, of the sheets P to be processed with the transport apparatus 10, so that in practice, the leading edge, in transport direction, of the sheet P reaches the position N2 of the downstream-side transport unit 4 before the trailing edge, in transport direction, of the sheet P leaves the position N1 of the upstream-side transport unit 2, and the transported sheets P are never in an entirely free state. The length of the unrestrained transport section 3 along the transport direction is 30-80 mm, preferably 40-50 mm.

However, in the time after the leading edge, in transport direction, of the transported sheets P has left N1 and before the leading edge reaches N2, the sheet P receives only the clamping force (that is, the transport force) of the upstream-side transport unit 2. For this reason, it is conceivable that while the leading edge, in transport direction, of a sheet P is in the unrestrained transport section 3, the leading edge, in transport direction, of this sheet P flaps and the transport orientation of the sheet P becomes instable, in particular at the leading edge.

Similarly, after the trailing edge, in transport direction, of a transported sheet P has left N1, the sheet P receives only the clamping force (that is, transport force) of the downstream-side transport unit 4. Therefore, it is conceivable that while the trailing edge, in transport direction, of the sheet P is in the unrestrained transport section 3, the trailing edge, in transport direction, of this sheet P flaps and the transport orientation of the sheet P becomes instable, in particular at the trailing edge.

Accordingly, the transport apparatus 10 according to this embodiment is provided with a mechanism for keeping the sheet P from flapping in the above-described unrestrained transport section 3. That is to say, the transport apparatus 10 of this embodiment includes, on both sides of the transport plane 1 of the unrestrained transport section 3, an upstream-side air-feed unit 5 for forming a flow of air that flows from the upstream side with respect to the transport direction to the downstream side with respect to the transport direction (i.e. in the transport direction), and, on both sides of the transport plane 1 of the unrestrained transport section 3, a downstream-side air-feed unit 6 for forming a flow of air that flows from the downstream side with respect to the transport direction to the upstream side with respect to the transport direction (i.e. counter to the transport direction).

It should be noted that the present explanation is for a transport apparatus 10 that is provided with both an upstream-side air-feed unit 5 and the downstream-side air-feed unit 6 flanking the unrestrained transport section 3, but it is also possible that only one of the upstream-side air-feed unit 5 and a downstream-side air-feed unit 6 are provided, and in either case, the effect of suppressing the flapping of the sheet P at the unrestrained transport section 3 can be achieved.

Alternatively, it is also possible to provide, on both sides of the transport plane 1 downstream from the unrestrained transport section 3, a downstream-side suctioning unit (not shown) that suctions air along the transport direction T, instead of the upstream-side air-feed unit 5 (or in addition to the upstream-side air-feed unit 5), or to provide, on both sides of the transport plane 1 upstream from the unrestrained transport section 3, an upstream-side suctioning unit (not shown) that suctions air in direction opposite to the transport direction T, instead of the downstream-side air-feed unit 6 (or in addition to the downstream-side air-feed unit 6).

The upstream-side air-feed unit 5 includes an upper air nozzle 5H, a lower air nozzle 5L, an upstream-side pump 5*a* and an upstream-side valve 5*b*. The upper air nozzle 5H is arranged above the transport plane 1, at a certain distance upstream (to the right in the drawing), with respect to the transport direction, from the upper transport rollers 2H of the upstream-side transport unit 2. The lower air nozzle 5L is arranged below the transport plane 1, at a certain distance upstream (to the right in the drawing), with respect to the transport direction, from the lower transport rollers 2L of the upstream-side transport unit 2. The upstream-side pump 5*a* is for feeding air to these two upper and lower air nozzles 5H, 5L, and the upstream-side valve 5*b* is provided in a conduit that connects the upstream-side pump 5*a* with the two air nozzles 5H, 5L.

The downstream-side air-feed unit 6 includes an upper air nozzle 6H, a lower air nozzle 6L, a downstream-side pump 6*a* and a downstream-side valve 6*b*. The upper air nozzle 6H is arranged above the transport plane 1, at a certain distance downstream (to the left in the drawing), with respect to the transport direction, from the upper transport rollers 4H of the downstream-side transport unit 4. The lower air nozzle 6L is arranged below the transport plane 1, at a certain distance downstream (to the left in the drawing), with respect to the transport direction, from the lower transport rollers 4L of the downstream-side transport unit 4. The downstream-side pump 6*a* is for feeding air to these two upper and lower air nozzles 6H, 6L, and the downstream-side valve 6*b* is provided in a conduit that connects the downstream-side pump 6*a* with the two air nozzles 6H, 6L.

The upper air nozzle 5H and the lower air nozzle 5L of the upstream-side air-feed unit 5 are laid out at positions that are mirror symmetric with respect to the transport plane 1 and have shapes that are mirror symmetric with respect to the transport plane 1. To explain this by way of example for the lower air nozzle 5L, as shown in FIG. 2, the lower air nozzle 5L has a flattened air nozzle shape, that widens up gradually from the upstream side towards the downstream side, with respect to the transport direction, and has a slit-shaped opening 7L that extends in the width direction W at its widened downstream end. In the present embodiment, the width of this opening 7L is set to about the same width as the width of the sheets P. Moreover, the lower air nozzle 5L is attached in such an orientation the slit-shaped opening 7L opens toward the downstream side in transport direction at a position near the transport plane 1.

That is to say, the air that is blown out from the opening 7L of this lower air nozzle 5L flows directly ahead in the same direction as the transport direction (forward direction) along the lower side of the transport plane 1, and forms a flattened air flow layer along the lower side of the transport plane 1. It should be noted that in the present embodiment, the pressure of the pump 5*a*, the inner diameter of the conduit, and the opening area of the opening 7L of the air nozzle and so on are set in such a manner that the speed component along the transport direction of this air flow layer is the same or greater than the transport speed of the sheets P.

In this situation, the air flow layer interferes slightly with the lower transport rollers 2L before it reaches the unrestrained transport section 3, but since the lower transport rollers 2L are thin, as mentioned above, the air flow layer can be kept from becoming unstable due to interference with the lower transport rollers 2L.

Similarly, the air that is blown out from the opening 7H of the upper air nozzle 5H, which has the same construction as the lower air nozzle 5L, flows directly ahead in the same direction as the transport direction (forward direction) along the upper side of the transport plane 1, and forms a flattened air flow layer along the upper side of the transport plane 1. It should be noted that in the present embodiment, the pressure of the pump 5*a*, the inner diameter of the conduit, and the opening area of the opening 7H of the air nozzle and so on are set in such a manner that the speed component along the transport direction of this air flow layer is the same or greater than the transport speed of the sheets P. That is to say, the flow of the air that is blown out from the two upper and lower air nozzles 5H and 5L has a mirror symmetric shape with respect to the transport plane 1.

On the other hand, also the upper air nozzle 6H and the lower air nozzle 6L of the downstream-side transport unit 6 are laid out at positions that are mirror symmetric with respect to the transport plane 1 and have shapes that are mirror symmetric with respect to the transport plane 1. To explain this by way of example for the lower air nozzle 6L, as shown in FIG. 2, the lower air nozzle 6L has a flattened air nozzle shape, that widens up gradually from the downstream side towards the upstream side, with respect to the transport direction, and has a slit-shaped opening 8L that extends in the width direction W at its widened upstream end. In the present embodiment, the width of this opening 8L is set to about the same width as the width of the sheets P. The lower air nozzle 6L is attached in such an orientation that the slit-shaped opening 8L opens toward the upstream side, with respect to the transport direction, at a position near the transport plane 1.

That is to say, the air that is blown out from the opening 8L of the lower air nozzle 6L flows straight in the direction opposite to the transport direction along the lower side of the transport plane 1, and forms a flattened air flow layer along the lower side of the transport plane 1. Since this counter-direction air flow layer flows in the direction opposite to the transport direction of the sheets P that are transported on the transport plane 1, it is not necessary to make its speed as fast as the speed of the air flow layer formed by the above-described upstream-side air-feed unit 5. For this reason, in the present embodiment, the speed of the air that is blown out through the air nozzles 6H and 6L of the downstream-side air-feed unit 6 is set to be slower than at the upstream-side air-feed unit 5.

Also the counter-direction air flow layer interferes slightly with the lower transport rollers 4L before it reaches the unrestrained transport section 3, but since the lower transport rollers 4L are thin, as mentioned above, the air flow layer can be kept from becoming unstable due to interference with the lower transport rollers 4L.

Similarly, the air that is blown out from the opening 8H of the upper air nozzle 6H, which has the same construction as the lower air nozzle 6L, flows directly ahead in the direction opposite to the transport direction along the upper side of the transport plane 1, and forms a flattened air flow layer along the upper side of the transport plane 1. That is to say, the flow of the air that is blown out from the two upper and lower air nozzles 6H and 6L has a mirror symmetric shape with respect to the transport plane 1.

The transport apparatus 10 of the present embodiment also includes a controller 9 (control device) for controlling the operation of the apparatus. The controller 9 may be for example a personal computer or portable computer (PC) or a control board or the like. The controller 9 is connected to the valve 5*b* of the upstream-side air-feed unit 5, the valve 6*b* of the downstream-side air-feed unit 6, the driving rollers 2D of the upstream-side transport unit 2, the driving rollers 4D of the downstream-side transport unit 4, two timing sensors 12, 14 and a sensor unit 13.

The valves 5*b*, 6*b* are provided in their respective conduits, at positions that are relatively close to the air nozzles 5H, 5L, 6H and 6L. Thus, air can be blown out from the air nozzles 5H, 5L, 6H and 6L (or the blowing of air can be stopped) immediately after switching the valves 5*b*, 6*b*, and the air flow layer can be quickly switched on and off.

The timing sensor 12 on the upstream side includes a light-emitting unit 12*a* that is arranged below the transport plane 1, and a light-receiving unit 12*b* that is arranged above the transport plane 1, opposite to the light-emitting unit 12*a*. The timing sensor 12 is arranged at a position where the optical axis of the light that is emitted from the light-emitting unit 12*a* and received with the light-receiving unit 12*b* passes through a location slightly to the upstream side of the position N1 at which the upper transport rollers 2H and the lower transport rollers 2L of the upstream-side transport unit 2 oppose each other. This timing sensor 12 detects that the sheet P transported on the transport plane 1 blocks this optical axis, thus detecting the passage of the sheet P.

The timing sensor 14 on the downstream side includes a light-emitting unit 14*a* that is arranged below the transport plane 1, and a light-receiving unit 14*b* that is arranged above the transport plane 1, opposite to the light-emitting unit 14*a*. The timing sensor 14 is arranged at a position where the optical axis of the light that is emitted from the light-emitting unit 14*a* and received with the light-receiving unit 14*b* passes through a location slightly to the downstream side of the position N2 at which the upper transport rollers 4H and the lower transport rollers 4L of the downstream-side transport unit 4 oppose each other. This timing sensor 14 detects that the sheet P transported on the transport plane 1 blocks this optical axis, thus detecting the passage of the sheet P.

The sensor unit 13 includes a light emitting/receiving unit 13*a* that is arranged below the transport plane 1 and a light receiving unit 13*b* that is arranged above the transport plane 1, opposite to the light emitting/receiving unit 13*a*. As shown in FIG. 2, the light emitting/receiving unit 13*a* extends in the width direction, which intersects with the transport direction of the sheets P, and also the light receiving unit 13*b* extends in the width direction, in opposition to the light emitting/receiving unit 13*a*. This sensor unit 13 is arranged at such a position that the light emitted from the light emitting/receiving unit 13*a* and received with the light receiving unit 13*b* perpendicularly traverses the transport plane 1 in the unrestrained transport section 3.

More specifically, the light emitting/receiving unit 13*a* includes a light source, such as a fluorescent lamp, that is thin and elongated in the width direction W, as well as a light receiving unit that is thin and elongated in the width direction, arranged next to the light source. The light receiving unit of this light emitting/receiving unit 13*a* receives the light that is reflected when light emitted from the light source is reflected at the sheet P that is transported on the transport plane 1. The light receiving unit 13*b*, which is arranged above the transport plane 1, receives the light that is emitted from the light source of the light emitting/receiving unit 13*a*. Therefore, the lengths of the light emitting/receiving unit 13*a* and the light receiving unit 13*b* in the width direction W is longer than at least the width of the sheets P that are transported on the transport plane 1.

The sensor unit 13 detects light that has passed through the sheets P that are transported on the transport plane 1 and/or light that is reflected from the sheets P, and detects various characteristics (such as shape, surface state or the like) of the sheets P. In particular, the sensor unit 13 is arranged in the middle of the unrestrained transport section 3, so that it can detect all regions of the sheets P when they are not held by the transport rollers or the transport belts. On the other hand, during unrestrained transport, the transport orientation of the sheets P tends to be instable. For this reason, it is important to increase the detection precision of the sheets P by stabilizing the transport orientation of the sheets P that are transported unrestrained.

Figure 3:
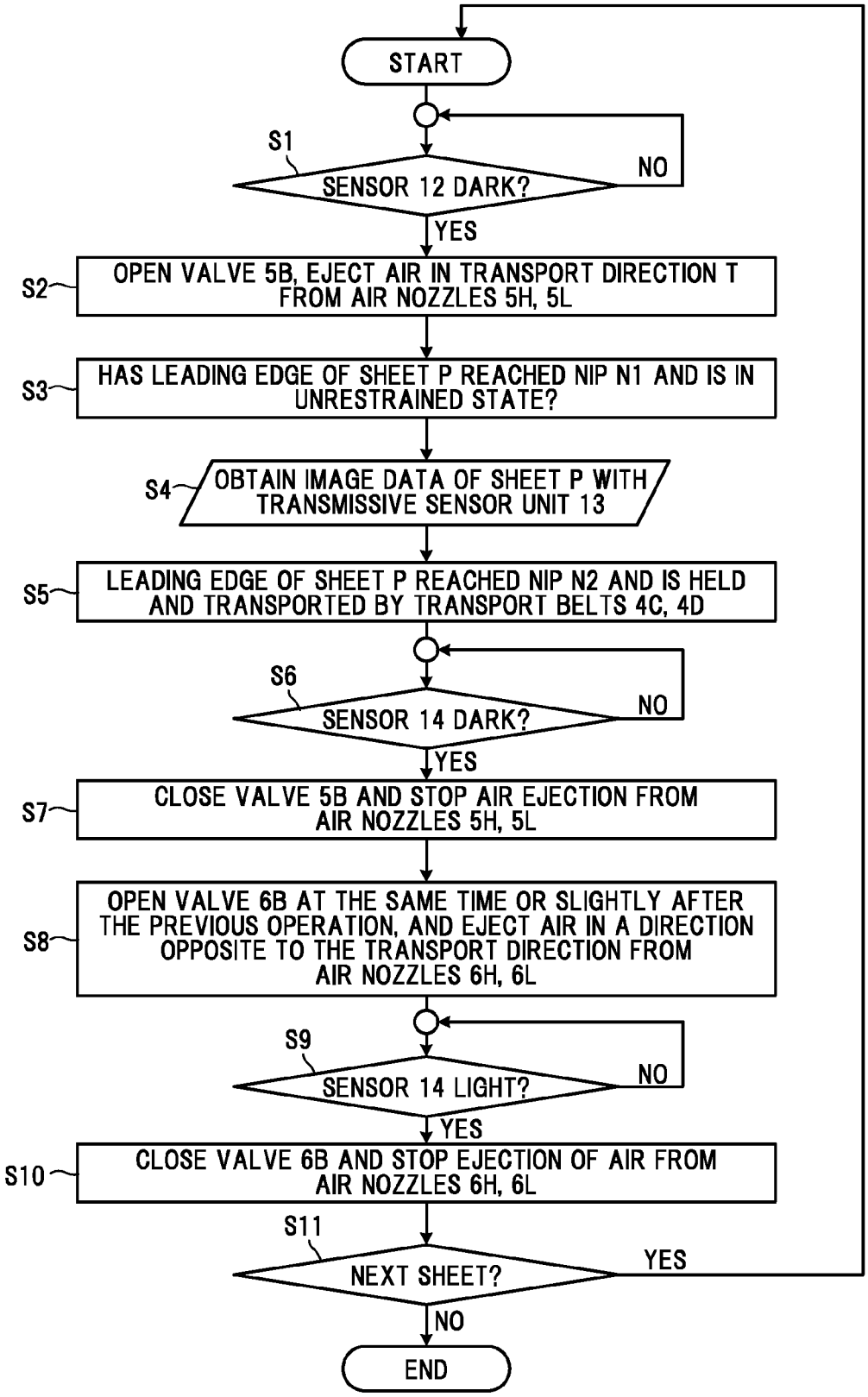
FIG. 3 is a flowchart illustrating the operation of the transport apparatus in FIG. 1.
Figures 4, 5:
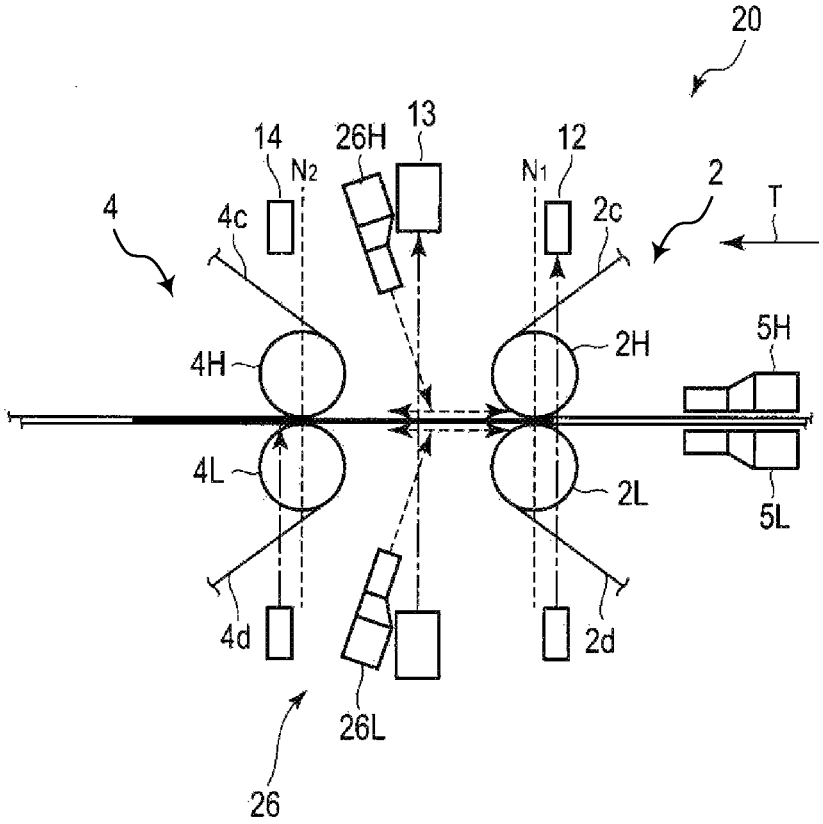
FIG. 4 is a diagram illustrating this operation of the transport apparatus in FIG. 1 together with FIG. 3.
FIG. 5 is a front view of a sheet transport apparatus according to a second embodiment.

The following is an explanation of the operation of the above-noted transport apparatus 10, with reference to the flowchart in FIG. 3, as well as FIG. 4. FIG. 4 shows the relationship between the output signal (light/dark) of the two timing sensors 12, 14 and the valve 5*b* of the upstream-side air-feed unit 5 and the valve 6*b* of the downstream-side air-feed unit 6.

When the leading edge, with respect to the transport direction, of a sheet P (referred to simply as "leading edge" in the following) that is transported in the arrow direction T along the transport plane 1 passes the upstream-side timing sensor 12 (FIG. 3, Step 1: YES), the controller 9 opens the valve 5*b* of the upstream-side air-feed unit 5 and ejects air in the transport direction T, via the slit-shaped openings 7H, 7L of the two air nozzles 5H, 5L on the upstream side (Step 2).

After this, the sheet P is transported forward, and when the region at the leading edge of the sheet P that has passed the transport nip N1 of the upstream-side transport unit 2 has assumed the free state (unrestrained state) (Step 3), the controller 9 obtains various kinds of data with the sensor unit 13, including image data of the sheet P that is transported through the unrestrained transport section 3, and starts the process of detecting the characteristics of the sheet P (Step 4).

In this situation, due to the stream of air that is ejected from the two upstream-side air nozzles 5H, 5L in Step 2, an air flow layer extending along the transport direction T is formed on both sides of the transport plane 1, and the transport orientation of the sheet P is stabilized in particular at its leading edge. Thus, the sheet P is kept from flapping, and the distance between the surface of the sheet P and the light emission unit or light reception unit of the sensor unit 13 is stabilized, increasing the detection precision of the sheet P.

That is to say, the sheet P whose leading edge has reached the unrestrained transport section 3 is transported at high speed to the downstream side of the transport nip N1 while being held only by the transport nip N1 of the upstream-side transport unit 2, so that the region at the leading edge, with respect to the transport direction, of the sheet P on the downstream side of N1 (also referred to simply as "leading edge" below) tends to flap. That is to say, the sheet P is not held in the unrestrained transport section 3. Such flapping of the sheet P is more conspicuous the thinner and less sturdy the sheet P is, and this may change for example due to static electricity, weight, air resistance, folding or bending of the sheet P.

In the present embodiment, in order to keep the leading edge from flapping, the above-described air flow layer is formed on both sides of the transport plane 1 in the unrestrained transport section 3, passing through the upstream-side transport unit 2 in the transport direction T. And since the air flow layer has a flow speed of the same or greater than the transport speed of the sheets P, the air flow layer exerts a biasing or energizing force that pushes the region of the sheet P on the downstream side of the region that is held by the transport nip N1 even further to the downstream side. Thus, the sheet P is transported in a state in which it is slightly stretched out to the downstream side, and the transport orientation of the sheet P is stabilized.

After this, the leading edge of the sheet P whose transport orientation is stabilized by the action of the upstream-side air-feed unit 5 is received by the transport nip N2 of the downstream-side air-feed unit 4 (Step 5), and when it passes the downstream-side timing sensor 14 (Step 6: YES), the controller 9 determines that the sheet P is held by the two transport nips N1, N2, and first closes the valve 5*b* of the upstream-side air-feed unit 5 to stop the ejection of air from the air nozzles 5H, 5L (Step 7).

In this state, the sheet P is transported in a state in which it is held by the two transport nips N1, N2 on the upstream side and the downstream side, so that the region at the leading edge of the sheet P does not flap in particular. This state continues until the trailing edge of the sheet P passes the transport nip N1 of the upstream-side air-feed unit 2.

It should be noted that it is important that the processing in Step 7 is carried out before the trailing edge of the sheet P leaves the transport nip N1 on the upstream side. If the valve 5*b* of the upstream-side air-feed unit 5 were closed and the flow of air of the upstream-side air-feed unit 5 cancelled after the trailing edge of the sheet P has left the transport nip N1 on the upstream side, then there would be the possibility that immediately after leaving the transport nip N1, the trailing edge of the sheet P is stirred up by the air flow layer that is not yet cancelled and the trailing edge flaps considerably.

Next, at the same time as the operation of Step 7, or after the operation of Step 7 and before the trailing edge of the sheet P leaves the transport nip N1 on the upstream side (that is, in a state in which the sheet P is held by the two transport nips N1 and N2), the controller 9 opens the valve 6*b* of the downstream-side air-feed unit 6, and air is ejected through the slit-shaped openings 8H, 8L of the downstream-side air nozzles 6H, 6L in the direction opposite to the transport direction T (Step 8).

In this situation, the flow of air of the downstream-side air-feed unit 6 may be started at the same time as when the flow of air of the upstream-side air-feed unit 5 is cancelled, or immediately after that, but there is no absolute necessity for this, and it is also possible to start the flow of air of the downstream-side air-feed unit 6 at the time when the trailing edge of the sheet P has passed the transport nip N1 (for example, at the point in time when the output of the timing sensor 12 has become light).

In any case, it is preferable that the timing at which the flow of air towards the downstream side in transport direction and the flow of air towards the upstream side are switched is set to a suitable timing that does not disturb the transport orientation of the transported sheet P. If, for example, the counter-direction air flow layer from the downstream-side air-feed unit 6 is formed at a point in time when the trailing edge of the sheet P has passed the transport nip N1 on the upstream side, then the amount by which the trailing edge of the sheet P flaps is temporarily increased, but on the other hand, it is possible to keep down the amount by which the leading edge flaps. For this reason, if it is permissible that the detection precision at the trailing edge of the sheet P drops slightly, then it is also possible to switch the direction of the air flow at this timing.

After this, when the sensor output of the timing sensor 12 on the upstream side turns from dark to light, the trailing edge of the sheet P passes the transport nip N1 on the upstream side, and the trailing edge of the sheet P travels freely. However, in the present embodiment, at this point in time, an air flow layer in the direction opposite to the transport direction T has already been formed on both sides of the transport plane 1 due to the flow of air that is ejected from the downstream-side air-feed unit 6 in Step 8, so that the trailing edge of the sheet P will not flap.

That is to say, in this state, the sheet P is held and transported only by the transport nip N2 of the downstream-side air-feed unit 4, and the air flow layer in the direction opposite to the transport direction T passing through the downstream-side air-feed unit 4 exerts a biasing or energizing force in a direction that acts on the region of the sheet P that is further to the upstream-side of the transport nip N2 in the direction opposite to the transport direction T. Thus, the sheet P is transported in a state in which it is stretched out in the transport direction T, in particular the trailing edge is kept from flapping, and the transport orientation of the sheet P is stabilized.

In this situation, the process of detecting characteristics of the sheet P with the sensor unit 13 (Step 4) is continued, and at the point in time when the trailing edge of the sheet P leaves the light path of the sensor unit 13, the controller 9 ends the process of detecting characteristics of the sheet P.

After that, the sheet P is transported further, and when the trailing edge passes the timing sensor 14 on the downstream side (Step 9: YES), the controller 9 determines that no sheet P is present in the unrestrained transport section 3, closes the valve 6*b* of the downstream-side air-feed unit 6, and cancels the flow of air through the air nozzles 6H, 6L (Step 10).

In this manner, until there is no more transported sheet P (Step 11: NO), the transport apparatus 10 of the present embodiment repeats the processing of the above-described Steps 1 to 10, and continuously transports a plurality of sheets P at high speed. It should be noted that in this situation, the gap between the sheets P that are continuously transported is set to be at least longer than the unrestrained transport section 3, and the transport control for the next sheet P has no influence on the transport control of the previous sheet P.

Thus, with the present embodiment, in a transport apparatus 10 that is provided with an unrestrained transport section 3 between a transport nip N1 of an upstream-side transport unit 2 and a transport nip N2 of a downstream-side transport unit 4, in a state in which the sheet P is held and restrained only by the transport nip N1 on the upstream side, a flow of air is formed via the upstream-side air-feed unit 5 along the transport direction T, and when the sheet P is held and restrained only by the transport nip N2 on the downstream side, a flow of air is formed via the downstream-side air-feed unit 6 in the direction opposite to the transport direction T, so that the sheet can be transported unrestrained in a stable orientation.

More specifically, with the transport apparatus 10 of the present embodiment, since an air flow of suitable direction is always formed at a suitable timing on both sides of the transport plane 1 in the unrestrained transport section 3, stable transport without jamming is possible, even when sheets that tend to flap due to air resistance are transported unrestrained, such as sheets with folds or other contortions or sheets with low rigidity and sturdiness.

Moreover, with the present embodiment, the same flow of air is formed on the upper side and on the lower side of the transport plane 1 (mirror symmetric with respect to the transport plane 1), so that it is possible to maintain a balance of the flow of air on the upper side and on the lower side of the transport plane 1, and the transport orientation can be stabilized even further.

Moreover, with the present embodiment, if sheets of a relatively good state without folds or contortions are transported, the amount by which the sheet flaps during transport can be reduced, and the detection precision of the sheets P can be further increased. Here, contortions refer to such sheet deformations as curling, creases, wave shapes and the like. In this case, the distance between the light emitting/receiving unit 13*a* of the sensor unit 13 that detects the characteristics of the sheet P and the lower side of the sheet P as well as the distance between the light receiving unit 13*b* of the sensor unit 13 and the upper side of the sheet P can be stabilized, and the detection precision can be improved.

Moreover, even for sheets P with folds and contortions or worn-out banknotes with low rigidity, since deformations and direction changes are suppressed through the guiding effect that the flow of air has, the risk of jamming that occurs when entering the transport nip N2 on the downstream side and of sheets dropping out at the unrestrained transport section 3 can be reduced.

It should be noted that in the above-described first embodiment, the flow of air in the opposite direction from the downstream-side air-feed unit 6 is simply made slower than the flow of air in the transport direction from the upstream-side air-feed unit 5, but in an actual apparatus, the flow speed of the air of the air-feed units 5 and 6 may be set to any suitable flow speed at which the transport orientation of the sheet P that is transported via the transport plane 1 does not flap. In this case, the suitable flow speed of the air-feed units 5, 6 differs depending on, for example, the type of sheet P to be transported or the transport speed of the sheet P with the transport apparatus 10. It should be noted that what is referred to here as flow speed is the speed component of the air flow along the transport direction (or the opposite direction).

Moreover, in the present embodiment, the shape of the openings 7H, 7L of the respective air nozzles 5H, 5L of the upstream-side air-feed unit 5 and the shape of the openings 8H, 8L of the respective air nozzles 6H, 6L of the downstream-side air-feed unit 6 is slit-shaped, extending in the width direction, but the shape of the openings is not limited to this. For example, it is also possible that a plurality of air nozzles having small openings are lined up in the width direction, and also the number of air nozzles can be set as appropriate. In this case, if the area of the openings made small (or narrow), it is possible to obtain the desired flow speed with relatively low pressure, and the ON/OFF switching speed can be made fast. Thus, it is possible to switch the direction of the air flow layer instantaneously, and to favorably control the transport orientation of the sheets P.

Moreover, in order to make the shape of the air flow layer formed by the air nozzles 5H, 5L (6H, 6L) more stable, it is also possible to provide a tank for pressurizing the air between the pump 5*a* (6*a*) and the valve 5*b* (6*b*). Thus, the pressurized air can be feed instantaneously to the air nozzles in the moment when the valves are opened, and it is possible to always eject air at a stable pressure. It should be noted that in this case, it is preferable that the conduits between the valves and the air nozzles are as short as possible, in order to instantaneously switch between ejection and stopping of the air.

Moreover, the above-described embodiment was explained for the case that the upstream-side transport unit 2 and the downstream-side transport unit 4 are provided as a belt transport mechanism, but there is no limitation to this, and it is also possible that a transport mechanism is provided in which simply transport rollers are arranged on both sides of the transport plane 1. Moreover, in the above-described embodiment, transmission-type sensors are used as the timing sensors 12, 14, but there is no limitation to this, and it is also possible to use reflection-type sensors. Furthermore, the above-described embodiment was explained for the case that the valve 5*b* of the upstream-side air-stream unit 5 and the valve 6*b* of the downstream-side air-stream unit 6 are provided separately, but there is no limitation to this, and it is also possible to use a single valve that can switch between air flow in the upstream-side air-feed unit 5 and air flow in the downstream-side air-feed unit 6. Alternatively, it is also possible to use a valve that can switch between three states, that is, in addition also the state that no air is supplied to any of the air-feed units.

Referring to FIG. 5, the following is an explanation of a sheet transport apparatus 20 according to a second embodiment (also simply referred to as "transport apparatus 20" below). It should be noted that this transport apparatus 20 has substantially the same structure as the above-described transport apparatus 10 of the first embodiment, with the exception that the attachment position and attachment angle of the two air nozzles 26H, 26L of a downstream-side air-feed unit 26 is different. Accordingly, the same reference numerals are assigned to structural elements that have the same function as in the first embodiment, and their further detailed explanation is omitted.

The upper air nozzle 26H of the downstream-side air-feed unit 26 that is arranged above the transport plane 1 is attached at a position that is removed from the transport plane 1, and at such an angle that it ejects air not perpendicularly with respect to the transport plane 1, but slightly obliquely downward from the downstream side toward the upstream side. That is to say, the air that is ejected from the upper air nozzle 26H is blown toward the transport plane 1 in the direction indicated by the broken line in the drawing. At this time, the attachment position and attachment angle of the upper air nozzle 26H are set such that air is blown towards the transport plane 1 slightly on the upstream side from the detection position of the sensor unit 13. It should be noted that the upper air nozzle 26H has the same opening shape as the air nozzle 6H of the first embodiment, so that the shape of the air ejected from this air nozzle is slit-shaped and elongated in the width direction.

On the other hand, the lower air nozzle 26L of the downstream-side air-feed unit 26 that is arranged below the transport plane 1 is attached at a position that is removed from the transport plane 1, and at such an angle that it ejects air not perpendicularly with respect to the transport plane 1, but slightly obliquely upward from the downstream side toward the upstream side. That is to say, the air that is ejected from the lower air nozzle 26L is blown toward the transport plane 1 in the direction indicated by the broken line in the drawing. At this time, the attachment position and attachment angle of the lower air nozzle 26L are set such that air is blown towards the transport plane 1 slightly on the upstream side from the detection position of the sensor unit 13. It should be noted that the lower air nozzle 26L has the same opening shape as the air nozzle 6L of the first embodiment, so that the shape of the air ejected from this air nozzle is slit-shaped and elongated in the width direction.

Now, if air is blown via the downstream-side air-feed unit 26 toward both sides of the transport plane 1 at the same timing as in the above-described first embodiment, the region at the trailing edge of the sheet P that is transported in a state in which it is held and restrained in the transport nip N2 of the downstream-side air-feed unit 4 is subjected to a force acting in a direction that returns it slightly to the upstream side. Thus, the sheet P is transported in a state in which it is partially stretched in the transport direction T, suppressing flapping. In particular, since a force acting in opposite direction acts on the sheet P on both sides in transport direction, and on both sides of the detection position of the sensor unit 13, flapping of the sheet P at the detection position can be effectively suppressed, and the detection precision can be increased.

Thus, with the present embodiment, by blowing the air obliquely toward the transport plane 1, it is possible to blow air on the sheet P that is pinpointed at the desired transport position of the sheet P that is transported along the transport plane 1, and it is possible to locally suppress flapping of the sheet P. In this case, as noted above, that flapping of the detected region of the sheet P is effectively suppressed locally.

Figure 6:
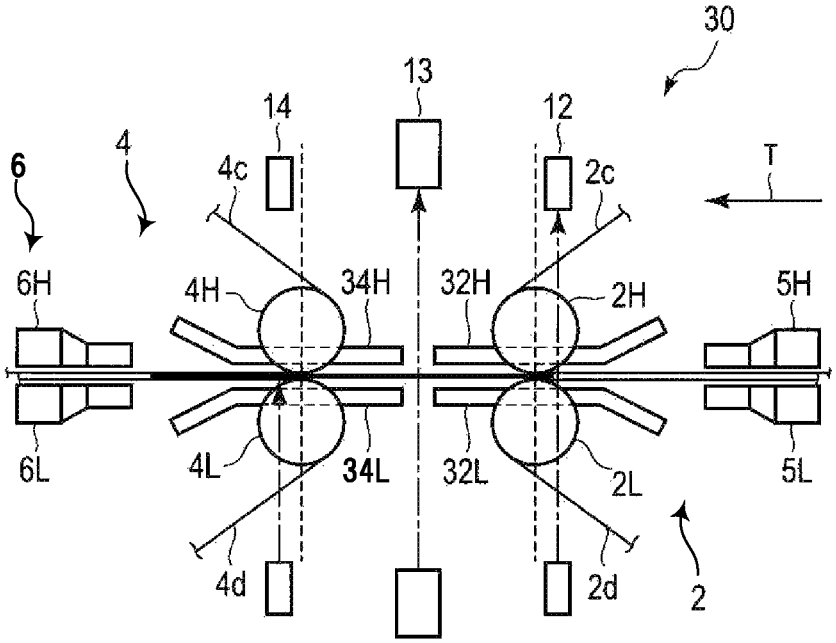
FIG. 6 is a front view of a sheet transport apparatus according to a third embodiment.
Figure 7:
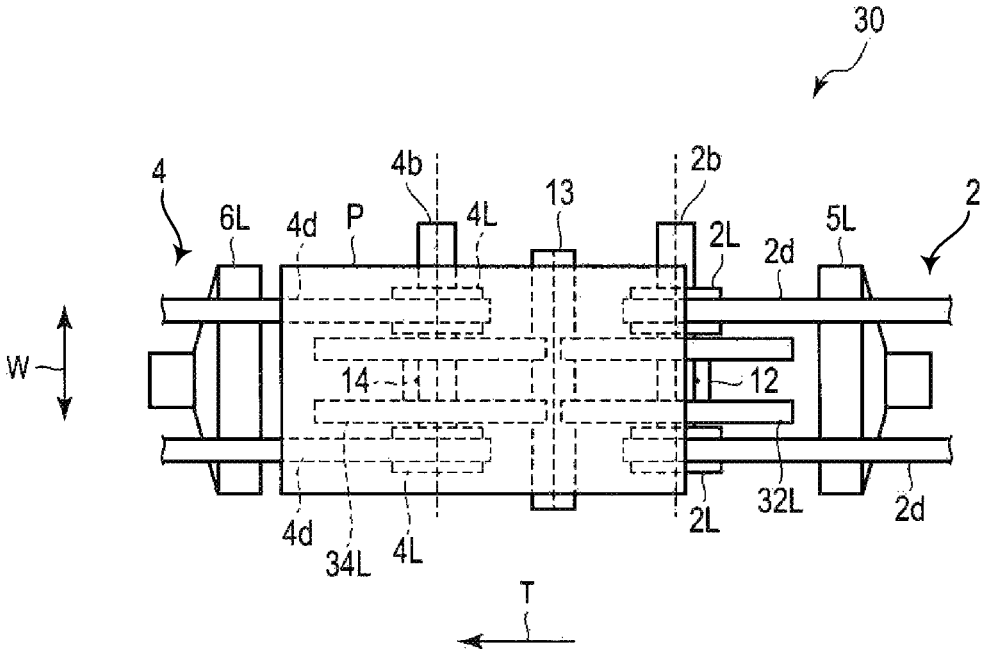
FIG. 7 is a top view of the transport apparatus in FIG. 6, viewed from above the transport plane.

FIG. 6 is a front view of a sheet transport apparatus 30 according to a third embodiment (also simply referred to as "transport apparatus 30" below), and FIG. 7 is a top view of this transport apparatus 30 taken from above the transport plane 1. It should be noted that in FIG. 7, structural elements above the transport plane 1 are not depicted. The transport apparatus 30 has substantially the same structure as the above-described transport apparatus 10 of the first embodiment, with the exception that it is provided with a plurality of transport guides 32H, 32L, 34H and 34L on both sides of the transport plane 1. Accordingly, the same reference numerals are assigned to structural elements that have the same function as in the first embodiment, and their further detailed explanation is omitted.

The transport guides arranged on the upstream side along the transport direction T include upper transport guides 32H that extend near and along the upper side of the transport plane 1 and lower transport guides 32L that are arranged near and along the lower side of the transport plane 1. The transport guides arranged on the downstream side along the transport direction T include upper transport guides 34H that extend near and along the upper side of the transport plane 1 and lower transport guides 34L that are arranged near and along the lower side of the transport plane 1. These four transport guides each have the same structure and are laid out mirror symmetric with respect to the transport plane 1.

For example, as shown in FIG. 7, the lower transport guides 32L on the upstream side are two narrow and elongated plate-shaped guides that are spaced apart from each other in the width direction W, and their ends on the upstream side in the transport direction are respectively bent obliquely in a direction away from the transport plane 1 (see FIG. 6). The lower transport guides 32L made from these two plate-shaped guides are arranged between the two lower transport belts 2*d* of the upstream-side transport unit 2. It should be noted that the lower transport guides 32L have such a shape that they do not interfere with the optical axis of the timing sensor 12 on the upstream side, the optical axis of the timing sensor 14 on the downstream side, or the optical path of the sensor unit 13.

The upper transport guides 32H on the upstream side, the upper transport guides 34H on the downstream side, and the lower transport guides 34L on the downstream side each have the same structure as the above-described lower transport guides 32L on the upstream side. Thus, detailed explanations of these transport guides 32H, 34H and 34L have been omitted.

Since in the present embodiment, a plurality of transport guides 32H, 32L, 34H and 34L are provided near both sides of the transport plane 1 near the unrestrained transport section 3, it is possible to suppress flapping of the sheets P more reliably. It should be noted that the transport guides of the present embodiment are a combination of narrow and elongated plate-shaped guides that extend in the transport direction, so that they do not impede the flow of air generated by the upstream-side air-feed unit 5 or the flow of air generated by the downstream-side air-feed unit 6. In other words, these transport guides may have any shape, as long as they do not disturb the air flow layer that is formed on both sides of the transport plane 1, and do not impede the detection of the sheets P with the various sensors.

Figure 8:
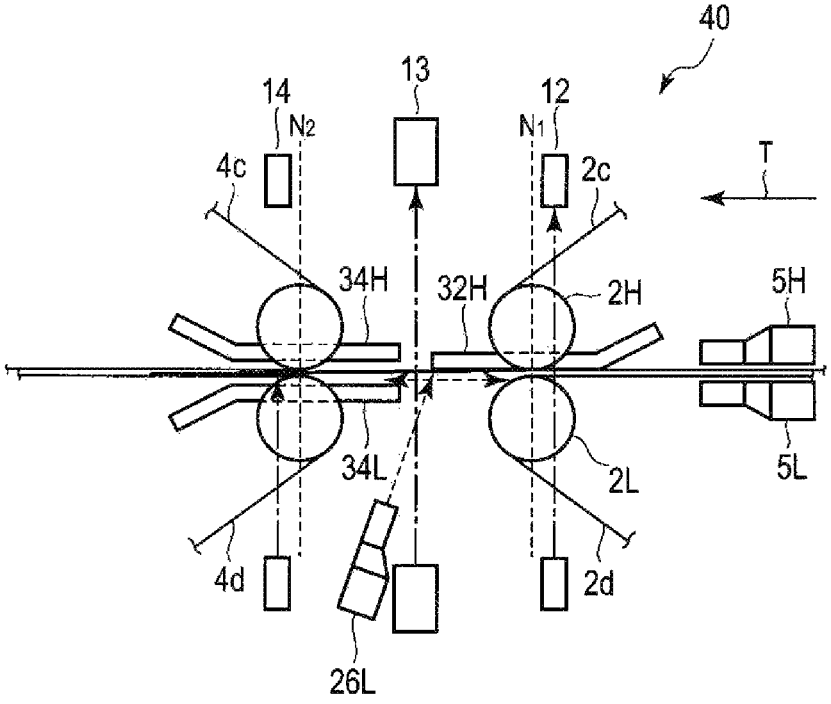
FIG. 8 is a front view of a sheet transport apparatus according to a fourth embodiment.

FIG. 8 is a front view of a sheet transport apparatus 40 according to a fourth embodiment (also simply referred to as "transport apparatus 40" below). The transport apparatus 40 has substantially the same structure as the above-described transport apparatus 30 of the third embodiment, with the exception that the lower transport guide 32L on the upstream side of the transport apparatus 30 of the third embodiment has been removed, and that the lower air nozzle 26L on the downstream side of the above-described transport apparatus 20 of the second embodiment has been added instead of the downstream-side air-feed unit 6 of the transport apparatus 30 of the third embodiment. Accordingly, the same reference numerals are assigned to structural elements that have the same function, and their further detailed explanation is omitted.

In this transport apparatus 40, air is blown with the lower air nozzle 26L of the downstream-side air-feed unit 26 from below the transport plane 1 obliquely upwards in upstream direction onto the sheet P that is transported while being held and restrained only by the transport nip N2 of the downstream-side transport unit 4. In this situation, the position onto which air is blown is set to the side of the upper transport guide 32H on the upstream side that faces the transport plane 1 (i.e. from below in the drawing).

Thus, a region of the sheet P that is located on the upstream side, with respect to the transport direction, of the transport nip N2 is pressed near the downstream-side end of the upper transport guide 32H by the air that is blown obliquely upward from the lower air nozzle 26L, and a force acting in the direction opposite to the transport direction T is applied at this position. Thus, also in this embodiment, as in the above-described transport apparatus 20 of the second embodiment, a force acts that stretches the sheet P in opposite directions at the two sides flanking the detection position of the sheet P, so that the detection precision of the sheet P can be increased.

With the sheet transport apparatus of at least one of the above-described embodiments, by providing an upstream-side air-feed unit that lets air flow from the upstream side of the unrestrained transport section in the transport direction along the transport plane, it is possible to stabilize the transport orientation of the sheets that are transported while being held and restrained by the transport nip on the upstream side of the unrestrained transport section, and to transport the sheets unrestrained with a stabilized orientation.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the foregoing embodiments, a transport apparatus was explained, that includes an upstream-side air-feed unit that blows air along the transport plane from an upstream side of the unrestrained transport section in transport direction, and a downstream-side air-feed unit that blows air along the transport plane from a downstream side of the unrestrained transport section in a direction opposite to the transport direction, but there is no limitation to this, and it is sufficient if at least the upstream-side air-feed unit is provided.

What is claimed is:

1. A sheet transport apparatus comprising:

an upstream-side transport unit configured to hold a sheet and transport the sheet by rotating;

a downstream-side transport unit configured to hold the sheet and further transport the sheet by rotating, the downstream-side transport unit being arranged at such a position that an unrestrained transport section is formed where the sheet is not held downstream in a transport direction from the upstream-side transport unit;

an upstream-side air-feed unit configured to form an air flow that flows downstream in the transport direction on both sides of a transport plane of the sheet in the unrestrained transport section;

a downstream-side air-feed unit configured to form an air flow that flows upstream, with respect to the transport direction, on both sides of the transport plane of the sheet in the unrestrained transport section;

a controller configured to control the upstream-side air-feed unit to start forming an air flow before a leading edge of the sheet reaches the unrestrained transport section from the upstream-side transport unit, to stop the air flow before a trailing edge of the sheet reaches the unrestrained transport section, and to control the downstream-side air-feed unit to start forming an air flow before the trailing edge, in transport direction, of the sheet that has been handed over to the downstream-side transport unit reaches the unrestrained transport section.

2. The sheet transport apparatus according to claim 1, wherein the downstream-side air-feed unit is configured to form an air flow that flows through the downstream-side transport unit.

3. The sheet transport apparatus according to claim 1, wherein the downstream-side air-feed unit comprises air nozzles that blow air obliquely onto both sides of the transport plane.

* * * * *